US006089934A

United States Patent [19]

Biggs et al.

[11] Patent Number: 6,089,934

[45] Date of Patent: Jul. 18, 2000

[54] ENGINE COOLING SYSTEM WITH SIMPLIFIED DRAIN AND FLUSHING PROCEDURE

[75] Inventors: Timothy M. Biggs, Stillwater; William E. Hughes, Perry; Matthew W. Jaeger, Stillwater; Andrew K. Logan, Stillwater; Robert J. Pitchford, Stillwater; Charles E. Wright, Stillwater, all of Okla.

[73] Assignee: Brunswick Corporation, Lake Forest, Ill.

[21] Appl. No.: 09/361,370

[22] Filed: Jul. 26, 1999

[51] Int. Cl.[7] ..... B63H 21/10

[52] U.S. Cl. ..... 440/88

[58] Field of Search ..... 440/88, 89; 123/41.14

[56] References Cited

U.S. PATENT DOCUMENTS

| | | | |
|---|---|---|---|
| 4,693,690 | 9/1987 | Henderson | 440/88 |
| 4,699,598 | 10/1987 | Bland et al. | 440/88 |
| 5,011,040 | 4/1991 | Kinast | 220/375 |
| 5,035,208 | 7/1991 | Culp | 123/41 |
| 5,334,063 | 8/1994 | Inoue et al. | 440/88 |
| 5,393,252 | 2/1995 | Brogdon | 440/88 |
| 5,423,703 | 6/1995 | Lorenzen | 440/88 |
| 5,441,431 | 8/1995 | Brogdon | 440/88 |
| 5,482,483 | 1/1996 | Rice | 440/88 |
| 5,664,526 | 9/1997 | Logan et al. | 440/88 |
| 5,671,906 | 9/1997 | Rosen | 251/148 |
| 5,813,888 | 9/1998 | Ozawa | 440/89 |

*Primary Examiner*—Stephen Avila
*Attorney, Agent, or Firm*—William D. Lanyi

[57] ABSTRACT

An engine cooling system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which is, in turn, attached to a handle. By manipulating the handle, the tether forces the retainer to slide along the flexible conduits and control the position of second ends of the flexible conduits. This allows the system to be moved from a first position with the second ends of the conduits above the first ends of the conduits to a second position with the second ends of the conduits below the first ends and in the bilge of the boat. The system allows an operator to stand in a single location and move the drain system from the first and second position and back again without having to reach down into the engine compartment to remove drain plugs. The system allows the cooling system to be easily drained or flushed.

20 Claims, 5 Drawing Sheets

ENGINE COOLING SYSTEM WITH SIMPLIFIED DRAIN AND FLUSHING PROCEDURE

BACKGROUND OF THE INVENTION

1. Field of the Invention

The present invention is generally related to a cooling system for an engine and, more particularly, to a system for effectively and efficiently draining a marine engine.

2. Description of the Prior Art

As is known to those skilled in the art, marine engines typically use cooling water that is drawn from the body of water in which the associated watercraft is operated. This system of drawing cooling water from the body of water in which the boat or watercraft is operated prevents the use of anti-freeze compounds since the cooling system generally does not comprise a closed cooling water containment. As a result, an internal combustion engine must be drained prior to its being subjected to freezing temperatures. Otherwise, any water contained within the engine's cooling system can freeze and possibly cause severe damage to the engine block and related components. For this reason, marine engines are usually provided with several drain plugs that can be temporarily removed by an operator or service technician to allow water to drain from the block into the bilge of the boat. From there, the water can easily be removed from the boat by a bilge pump if the boat is in the water or, alternatively, through a transom drain opening if the boat is out of the water on a trailer or hoist. Many different techniques and products have been developed over the years which allow a boat operator to drain the water from the engine cooling system.

A related problem concerns the flushing of an engine's cooling system with fresh water after it has been used in a salt water or contaminated water environment. When a marine engine is used in these conditions, the engine cooling system draws salt water or contaminated water from the body of water on which the boat is operated and uses this water for the purpose of cooling the engine. After using the boat in this manner, it is recommended that the engine cooling system be flushed with fresh water in order to remove contaminants, such as salt residue, from the internal passages of the engine block and other components of the cooling system. It is well documented that these procedures will prolong the operational life of the engine and associated components. Many devices have been developed for the purpose of flushing a marine engine in addition to draining the marine engine to remove all contaminants and residue water from the block to prevent damage when the engine is subjected to freezing temperatures.

U.S. Pat. No. 4,699,598, which issued to Bland et al on Oct. 13, 1987, describes a marine propulsion device water supply system. The device comprises an internal combustion engine, a propulsion unit adapted to be pivotally mounted on the transom of a boat for pivotal movement relative to the transom about a generally vertical steering axis, and about a generally horizontal tilt axis, the propulsion including a propeller operably connected to the engine. The device further comprises a pump for pumping water from the exterior of the propulsion unit to the engine and a conduit extending from the pump to the engine and having a low point below both the pump and the connection of the conduit to the engine. It further comprises a drain for draining water from adjacent the low point of the conduit.

U.S. Pat. No. 5,035,208, which issued to Culp on Jul. 30, 1991, describes a method and device for winterizing boat engines. The system includes a "Y" valve having stopped cocks located on the common duct and each arm. One arm is connected to a source of flushing liquid and the other to a source of anti-freeze. The common duct is connected to the engine.

U.S. Pat. No. 5,334,063, which issued to Inoue et al on Aug. 2, 1994, describes a cooling system for a marine propulsion engine. Certain embodiments of the system have water cooled internal combustion engines in which the cooling jacket of the engine is at least partially positioned below the level of the water in which the watercraft is operating. The described embodiments all permit draining of the engine cooling jacket when it is not being operated. In some embodiments, the drain valve also controls the communication of the coolant from the body of water in which the watercraft is operating with the engine cooling jacket. Various types of pumping arrangements are disclosed for pumping the bilge and automatic valve operation is also disclosed.

U.S. Pat. No. 5,393,252, which issued to Brogdon on Feb. 28, 1995, describes a fresh water flushing system from a marine engine system in a boat for use whether the boat is in or out of the water. The system comprises a control panel mounted in the proximity of the marine engine and a fresh water flush valve. Hoses are connected to the fresh water flush valve and to various components of the marine engine system to provide for fresh water fluid flow within the engine. Alternative embodiments are included for marine vessels with more than one engine.

U.S. Pat. No. 5,813,888, which issued to Ozawa on Sep. 29, 1998, describes a system for flushing a watercraft engine cooling system. The system includes a conduit which is connected to a source of fresh water and is inserted into an adapter located in the upper body of the watercraft. A self-closing valve is attached to the adapter for sealing the adapter and the conduit automatically opens the valve when it is connected to the adapter to allow fresh water to flow through the adapter and into the cooling jacket of the engine.

U.S. Pat. No. 5,671,906, which issued to Rosen on Sep. 30, 1997, discloses a flush valve. It is intended for use with a water cooled marine outboard engine having a flush orifice. The valve includes a valve body having an engine attachment and a flush water source end. The valve body has a channel between the engine end and the source end. The engine end of the valve body can be affixed into the flush orifice of the engine. The flush valve also includes a means for obstructing a discharge flow of cooling liquid from the engine end of the hollow valve body.

U.S. Pat. No. 5,441,431, which issued to Brogdon on Aug. 15, 1995, describes a fresh water flushing system for a marine engine in a boat. The system is intended for use whether the boat is in or out of the water. The system comprises a control panel mounted on the interior of the boat, a plurality of tubular T-shaped interconnection fittings in a raw sea water cooling conduit, and a fresh water flush valve. The components are connected for fresh water fluid flow. The fresh water flush valve has a valve plunger for establishing fresh water flow between the control panel and the T-shaped interconnection fittings.

U.S. Pat. No. 4,693,690, which issued to Henderson on Sep. 15, 1987, describes a quick drain assembly for a boat engine. The device is used for a inboard boat engine, especially an engine of the type having a water jacket to which a plurality of drain cocks are connected through which the engine coolant must be drained after each use of the engine. The quick drain device is in the form of a barrel having a plurality of lateral tubes radiating therefrom. An expandable stopper is received within the barrel and covers the ends of the tubes and thereby prevents fluid flow through the device. The other ends of the lateral tubes are connected to the drain cocks or drain plugs located on the engine block. Removal of the expandable stopper simultaneously drains all of the drain plugs.

In a typical marine engine, some drain openings must be located at positions near or at the bottom of the engine. This assures that all of the water can be drained, via gravity, from the engine block. If drain plugs are provided in these drain openings, a boat operator must first manually remove the plugs in order to drain the cooling water from the engine block. In many installations, these drain plugs are difficult to access because of their location on the engine. In certain systems, hoses and remotely located drain plugs are provided near or through the transom of the boat. These systems are generally more complicated and expensive than the simple systems in which the operator is required to manually remove plugs from the openings in the engine block and exhaust manifold structures. It would therefore be significantly beneficial if a relatively simple system could be devised which allows the operator to drain the water from the cooling system of a marine engine without having to manually reach under the engine to remove the drain plugs. It would also be beneficial if a relatively simple system could be provided that did not require special plumbing and valving for the purpose of draining the water into the bilge or through the transom. The present invention is directed to provide those beneficial solutions.

SUMMARY OF THE INVENTION

An engine cooling system made in accordance with the present invention comprises a first opening extending through a first portion of the engine and into the cooling system of the engine. A first flexible conduit has a first end connected in fluid communication with the first opening. A retainer is movably attached to the first flexible conduit and is movable between the first end of the first flexible conduit and a second end of the first flexible conduit. The present invention further comprises a handle and a tether that is attached between the handle and the retainer. The second end of the first flexible conduit is movable in response to manual movement of the handle from a first position above the first opening to a second position below the first opening. By moving the handle, the tether allows the retainer to be lowered relative to the engine to a place below the first opening. This, in turn, causes the second end of the first flexible conduit to be moved to a position lower than the first opening. Water can therefore be drained from the engine into the bilge of the boat by a simple manipulation of the handle and tether.

The present invention can further comprise a stationary bracket with the tether passing through an aperture in the bracket. The aperture is disposed between the handle and the retainer. The stationary bracket can also comprise a plate through which the aperture is formed. The plate has a stud attached thereto with the stud being shaped to be received in liquid sealing association within the second end of the first flexible conduit. To facilitate this liquid sealing association between the stud and the second end of the first flexible conduit, a fluid coupling can be attached to the second end of the first flexible conduit with the fluid coupling being shaped to receive the stud therein.

The stationary bracket can be rigidly attached to the engine, but this is not necessary in all applications of the present invention.

In a typical application of the present invention, the engine cooling system further comprises a second opening extending through a second portion of the engine and into the cooling system. In addition, it comprises a second flexible conduit having a first end connected in fluid communication with the second opening. The retainer is movably attached to the second flexible conduit and the first flexible conduit and is movable between the first ends of the first and second flexible conduits and the second ends of the first and second flexible conduits. In other words, both the first and second flexible conduits are moved in tandem with each other in a preferred embodiment of the present invention. Other embodiments could comprise different configurations. The first opening can be formed in an exhaust manifold of the engine and the second opening can be formed in a block of the engine.

The tether, in a particularly preferred embodiment of the present invention, is a steel wire reinforced structure with a non-metallic coating.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
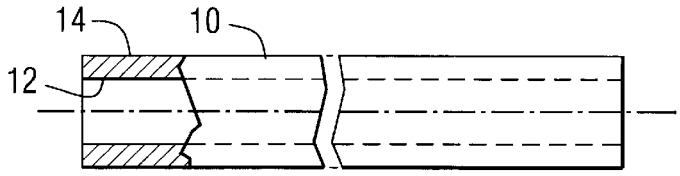
FIG. 1 shows a section view of a flexible conduit used in conjunction with the present invention.

Throughout the description of the preferred embodiment, like components will be identified by like reference numerals.

FIG. 1 illustrates a flexible conduit 10 that has an internal diameter 12 of approximately 0.378 inches and an outside diameter 14 of approximately 0.617 inches. In accordance with the present invention, flexible conduits of various lengths can be used, but a particularly preferred embodiment of the present invention for one particular application uses a flexible conduit 10 having a length of approximately 22.0 inches. Two flexible conduits are used in a preferred embodiment of the present invention. A certain type of hose, referred to as a "Jiffy Hose", is used in conjunction with associated barbed connectors, in a preferred embodiment of the present invention, to avoid the need for hose clamps. These types of hoses are available in commercial quantities from the Dayco Corporation.

Figure 2:
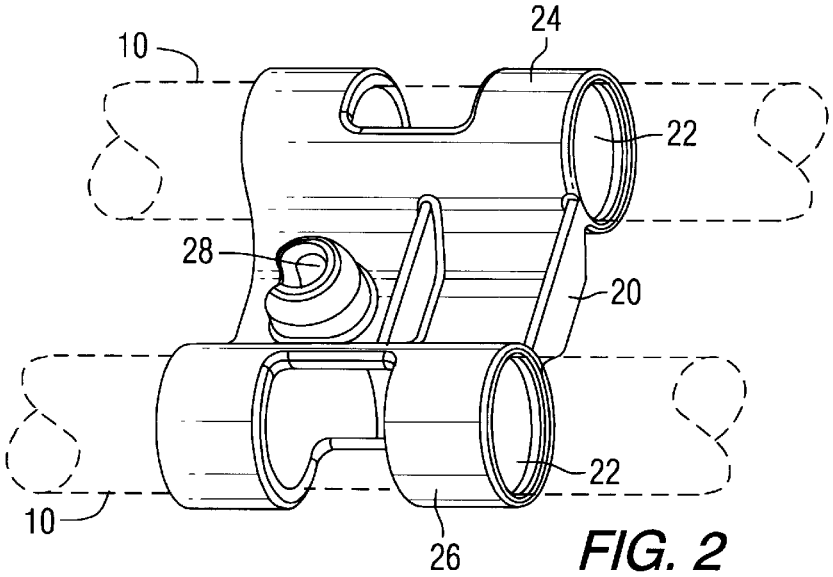
FIG. 2 shows a retainer used in conjunction with the present invention.

FIG. 2 illustrates a retainer 20 which is used in a preferred embodiment of the present invention. The retainer 20 is movably attached to two flexible conduits 10 that are represented by dashed lines in FIG. 2. The retainer 20 is movable between first and second ends of the flexible conduits. Generally cylindrical openings 22 at the two sides, 24 and 26, of the retainer 20 are shaped to receive the flexible conduits 10, or hoses, in sliding association therein. If the first end of a first flexible conduit is attached is a first opening, such as an exhaust manifold drain, and the first end of a second flexible conduit is attached to a second opening, such as a drain opening in an engine block, the retainer 20 can slide along the two flexible conduits 10, or hoses, between their first and second ends.

Figure 3:
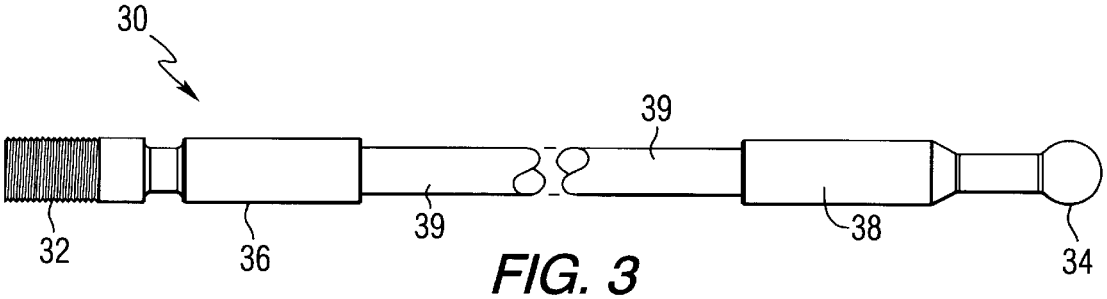
FIG. 3 shows a tether used in conjunction with the present invention.

FIG. 3 shows a tether 30 which has a threaded end 32 and a spherical end 34. These components are made of UNS C36000 brass, but other materials can be used in alternative embodiments of the present invention. The threaded end 32 is formed in a metallic end piece 36 and the spherical end 34 is formed in a different metallic end piece 38. Between the two metallic end pieces, 36 and 38, a steel wire reinforced structure with a non-metallic coating 39 is attached to both metallic end pieces, 36 and 38. The steel wire reinforced structure 39 is approximately 0.270 inches in diameter in a preferred embodiment of the present invention. The metallic end piece 36 is approximately 1.465 inches long. The threaded portion 32 is approximately 0.54 inches long. The metallic end piece 36 is approximately 0.375 inches in diameter. The metallic end piece 38 is approximately 2.018 inches long. The entire length of the tether 30 is approximately 19.278 inches, excluding the threaded portion 32. The steel wire reinforced structure 39 is selected to have a certain degree of flexibility which assists an operator in manipulating the retainer 20. In response to a force of approximately 100 grams on the spherical end 34 in a direction perpendicular to the centerline of the tether 30, the entire length of the device is intended to deflect from its original centerline by a magnitude of approximately 4.69 inches. Although these dimensions and specifications are not intended to be limiting to the present invention, it has been determined that they combine to provide a particularly useful tether 30 when used in conjunction with the retainer 20 and flexible conduits 10 as described above in conjunction with FIGS. 1 and 2. The degree of flexibility described immediately above allows the tether 30 to move freely in response to movement of the handle 40 by an operator, but also provide sufficient stiffness to allow the operator to push downward against the retainer, as will be described in greater detail below, in order to force the flexible conduits 10 to a position where their second ends are below their first ends.

Figure 4:
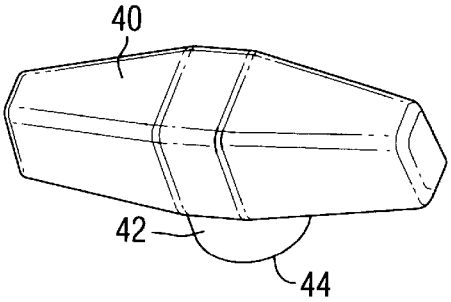
FIG. 4 is a handle which is attached to the tether of FIG. 3 in a preferred embodiment of the present invention.

FIG. 4 shows a handle 40 that is suitable for gripping by an operator. An extension 42 of the handle 40 has an opening 44 (not visible in FIG. 4) which is threaded to receive the threaded end 32 of the tether 30 described above in conjunction with FIG. 3.

With reference to FIGS. 1, 2, 3 and 4, the spherical end 34 of the tether 30 is shaped to be received in a generally spherical pocket 28 of the retainer 20. In one embodiment, the spherical end 34 is held in place within a snap-fit component that serves as the spherical pocket 28. Using plastic components facilitates this snap-fit assembly procedure. The cylindrical openings of the retainer 20 are shaped to allow it to slide over the two flexible conduits 10. The inside diameters of the cylindrical openings 22 are approximately 0.750 inches to allow this relative motion between the retainer 20 and the flexible conduits 10. When the handle 40 is attached to the threaded end 32 of the tether 30 and the spherical end 34 of the tether 30 is disposed in the spherical pocket 28 of the retainer 20, manual manipulation of the handle 40 can cause the retainer 20 to move along the lengths of first and second flexible conduits between their first and second ends, pulling the flexible conduits upward or pushing them downward.

Figure 5:
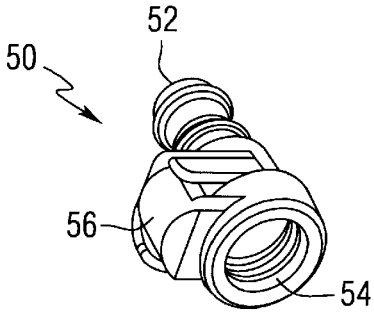
FIG. 5 is a fluid tether attached to one end of the fluid conduit of FIG. 1.

FIG. 5 shows a fluid coupling 50 having a male end 52 that is shaped to be received in the second end of the flexible conduit 10. A female end 54 of the fluid coupling 50 is shaped to be received by a stud that will be described in greater detail below to seal the second end and prevent liquid flow through the flexible conduit. A finger operable button 56 can be pushed radially toward the centerline of the fluid coupling 50 to release the attachment between the fluid coupling 50 and the stud. The second ends of the first and second flexible conduits, as will be described in greater detail below, are both provided with a fluid coupling 50 in a preferred embodiment of the present invention.

Figure 6A:
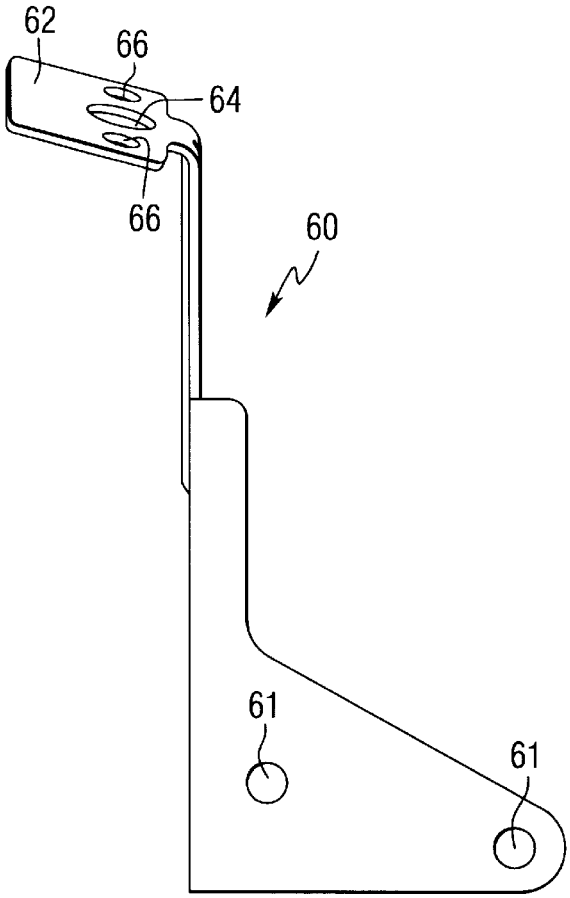
FIGS. 6A, 6B, and 6C are different view of a bracket used in conjunction with the preferred embodiment of the present invention.
Figure 6B:
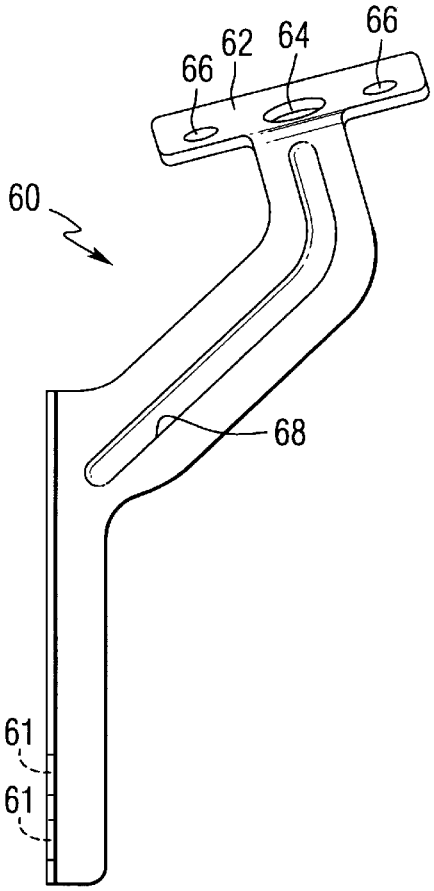
Figure 7:
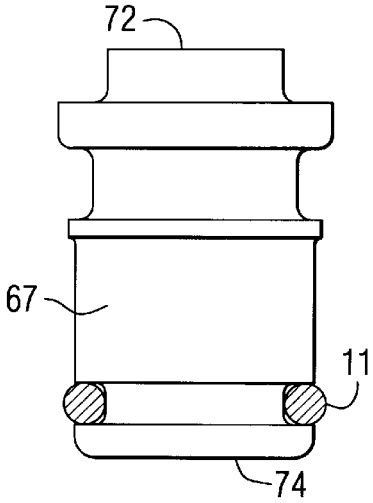
FIG. 7 is a stud attached to the bracket.
Figure 6C:
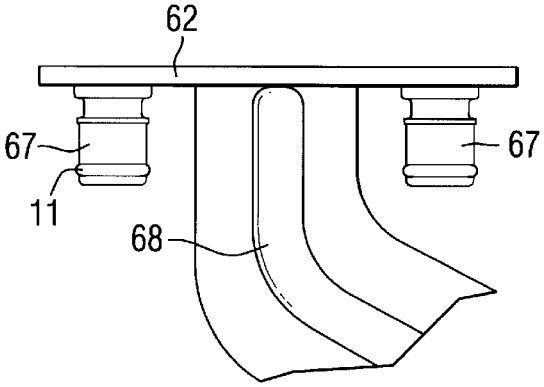

FIGS. 6A and 6B show two views of a bracket 60 which can be used in conjunction with the present invention. Two holes 61 are formed in the bracket 60 to allow it to be attached to a stationary object, such as the engine. The bracket 60 has plate 62 with an aperture 64 formed through the plate 62. The aperture 64 is shaped to allow the tether 30 to pass through the plate 62 with ease. A plastic bushing (not shown in FIGS. 6A and 6B) can be used to protect the surface of the plate 62, but this is not required in all embodiments of the present invention. The plate also has two other openings 66 that are each shaped to receive a stud 67 in rigid attachment to the plate 62 as illustrated in FIG. 6C. Although many different techniques can be used to attach the stud 67 to the plate 62, a preferred embodiment of the present invention uses studs 67 that are made of a malleable brass, such as UNS C36000 brass. The holes 66 in the plate 62 are punched with the breakout on the side of the bracket opposite the side from which the studs 67 will extend away from the plate 62. This punching operation typically provides a slight conical shape to the hole that is used as an aid in the retention of the studs 67. The end 72 of the stud 67, is illustrated in FIG. 7, is then inserted into the hole 66 and swaged to rigidly attach the stud 67 to the plate 62. The swaging operation flares the stud 67 into the conical hole and provides axial retention. It should be understood that other retention means are available within the scope of the present invention and the swaging operation is not limiting to the present invention. The purpose of the studs 67 is twofold. First, by attaching the second ends of the flexible conduits to the studs 67, the second ends will be retained in a fixed position near the plate 62. This fixed position provides easy access to the operator when the operator chooses to drain the engine cooling system. Secondly, the studs 67 seal the second ends of the flexible conduits 10 when the studs are inserted into the female end 54 of the fluid coupling 50. Sealing is provided by the Nitrile O-ring 11 shown in FIGS. 6C and 7. The studs 67 are shaped to be received in the female end 54 of the fluid coupling 50 which, in turn, has a male end 52 that is shaped to be received into the first end of the flexible conduit 10.

With continued reference to FIGS. 6A, 6B and 6C, a raised portion 68 is formed in the bracket 60 in a particularly preferred embodiment of the present invention to provide improved strength and stiffness. The tether 30 extends through the aperture 64. The aperture 64 is disposed between the handle 40 and the retainer 20.

FIG. 7 is an enlarged view of a stud 67. The outer end 72 in FIG. 7 is shaped to be received in the openings 66 and rigidly attached to the plate 62. The opposite end 74 is shaped to be received in the female end 54 of the fluid coupling 50 described above in conjunction with FIG. 5. FIG. 6C shows two studs 67 rigidly and permanently attached to the plate 62.

Figure 8:
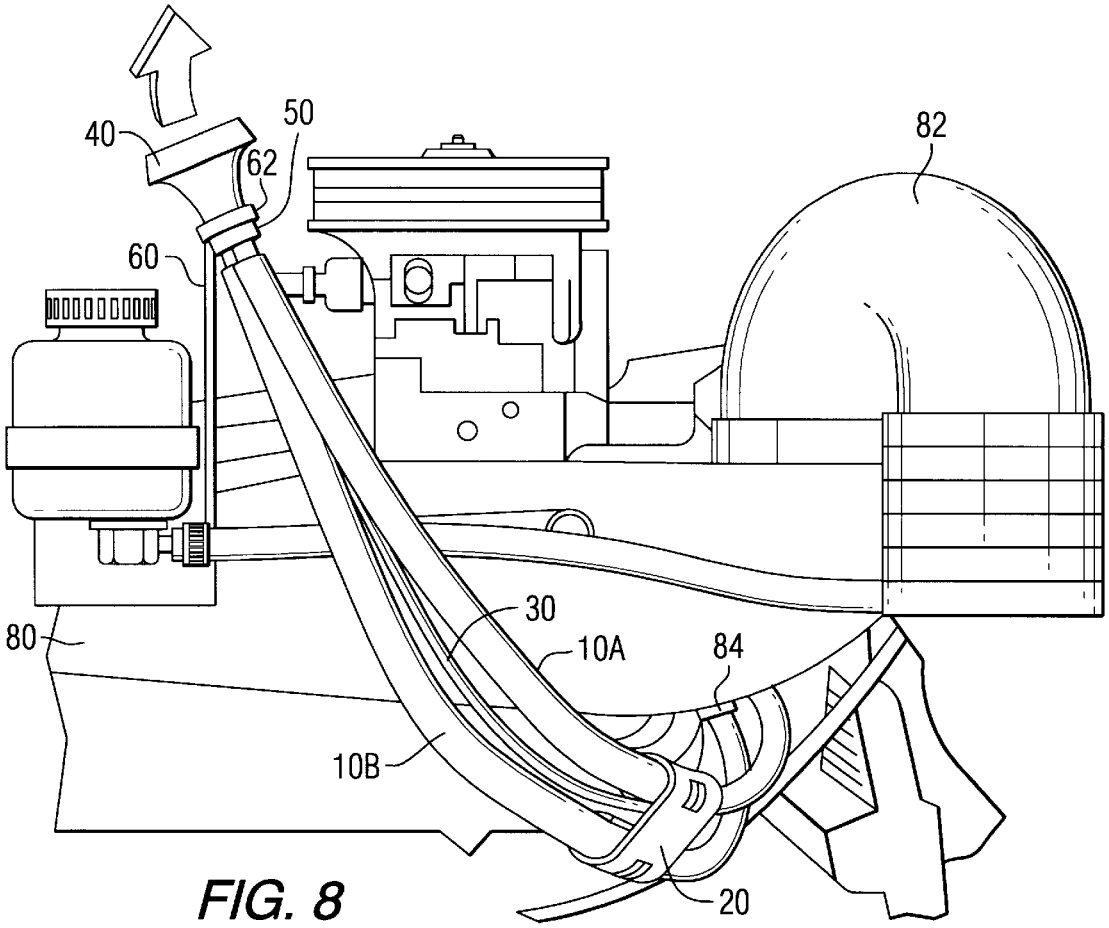
FIG. 8 shows the present invention attached to an engine and placed in a mode for operation of the engine.

FIG. 8 is a highly simplified side view of an engine 80 with an exhaust manifold and elbow 82. In accordance with standard procedures, the hoses, 10A and 10B, are colored blue to identify them as water service points on the engine. FIG. 8 also shows a first flexible conduit 10A and a second flexible conduit 10B. The first flexible conduit 10A is connected to a first opening that extends through a first portion of the engine 80 and into its cooling system. For example, a first end 84 of the first flexible conduit 10A, on the outboard side, is connected to the engine block 80. A first end (not shown in FIG. 8) of the second flexible conduit 10B can be connected to a second opening that is formed in the exhaust manifold and elbow 82. The retainer 20 is shown with both first and second flexible conduits 10A and 10B extending through it. The retainer 20 is movable along the lengths of the first and second flexible conduits between their first ends and second ends. One end of the tether 30 is attached to the retainer 20. As described above, the connection between the retainer 20 and the tether 30 is a spherical end 34 of the tether 30 disposed in a spherical pocket 28 of the retainer 20 in a preferred embodiment of the present invention. The opposite end of the tether 30 is attached to the handle 40 which rests on the plate 62, or an associated bushing, of the bracket 60 which is rigidly attached to a stationary component of the engine 80. Fluid couplings 50, which are inserted into the second ends of both the first and second conduits, 10A and 10B, are held in place at the plate 62 by being attached to studs 67 in the manner described above. This retains the second ends of the first and second flexible conduits in place at the plate 62 and seals them to prevent liquid flow through the flexible conduits. In the configuration represented in FIG. 8, the engine 80 can be operated normally without water flowing out of the cooling system.

Figure 9:
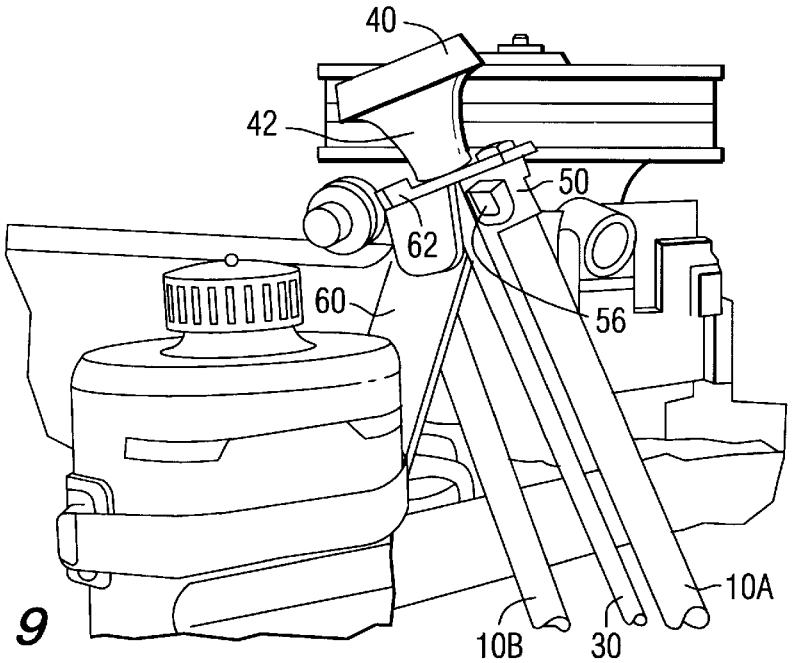
FIG. 9 is an enlarged view of a portion of FIG. 8.

FIG. 9 is a slightly enlarged view of the upper portion of the present invention, showing the handle 40, the plate 62, the fluid couplings 50, the bracket 60, and the first and second flexible conduits, 10A and 10B. Also shown in FIG. 9 is the tether 30 which is threaded into the extension 42 of the handle 40

Figure 10:
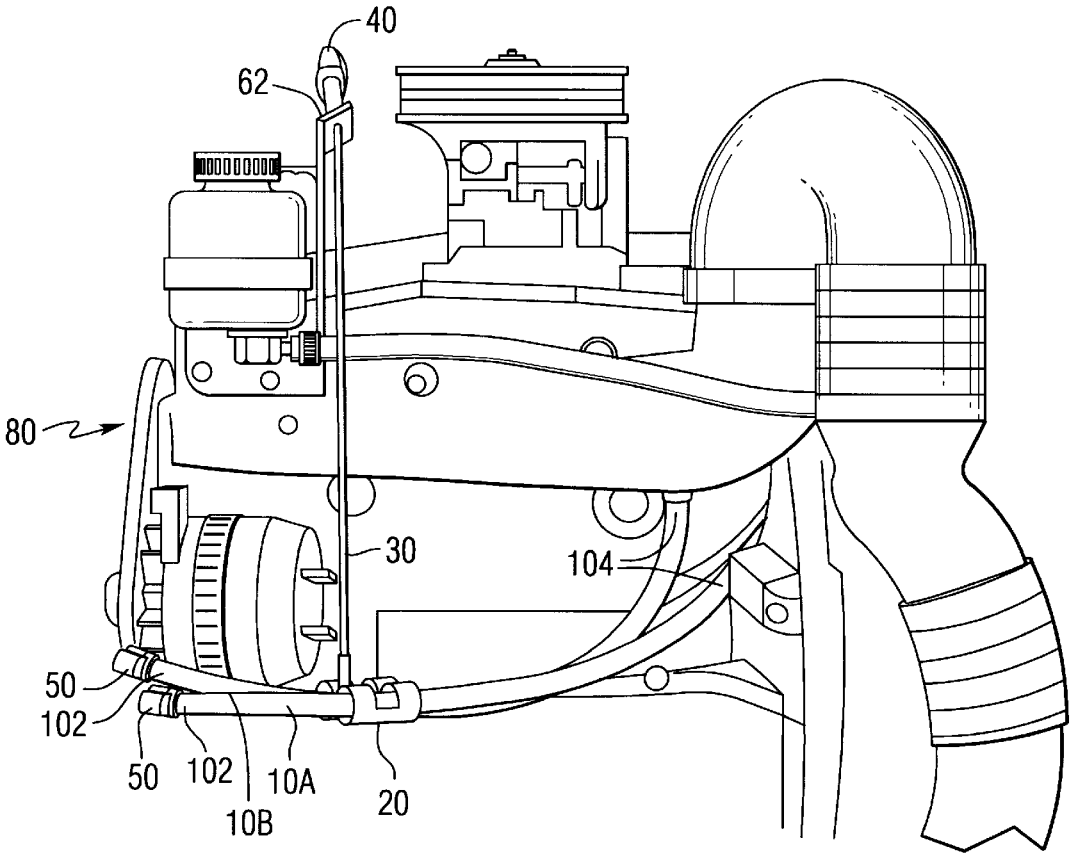
FIG. 10 is the system of the present invention placed in a draining mode to remove water from the engine and its accessories.

FIG. 10 shows the present invention after the fluid couplings 50 of both the first and second flexible conduits, 10A and 10B, are disconnected from their respective associated studs 67 which remain rigidly attached to the plate 62. After the fluid couplings 50 are disconnected from the studs 67, the handle 40 is used to move the retainer 20 down to a low position relative to the engine 80 and, more specifically, to force the second ends 102 of both flexible conduits to positions below their respective first ends 104. This allows water to drain through the first and second openings of the engine 80 and through the first and second flexible conduits, 10A and 10B. The limited flexibility of the tether 30 allows the operator to force the retainer 20 to a lower position, as shown in FIG. 10, by manipulation of the handle 40. If the tether 30 did not have some slight degree of rigidity, this forcing of the second ends 102 to a low position relative to the engine 80 may be more difficult.

With reference to FIGS. 8 and 10, it can be seen that the second ends 102 of the first and second flexible conduits can be raised or lowered easily by manipulation of the handle 40 without the operator being required to move away from the location of the plate 62. Other systems known to those skilled in the art require the operator to reach under the engine 80 to remove drain plugs. In addition, certain known systems require the operator to reach down to a position in the bilge near the transom to activate valves for these purposes. In the present invention, however, the operator can stand at a location near the plate 62 and raise or lower the flexible conduits by simply lifting the handle 40. In other words, to move from the circumstance illustrated in FIG. 10 to the circumstance illustrated in FIG. 8, the operator merely has to raise the handle 40 and tether 30 to lift the retainer 20 upward toward the plate 62. When the second ends 102 are near the plate 62, the operator then attaches the fluid couplings 50 to their respective studs 67 that are attached to the plate 62. This seals the second ends 102 of both of the flexible conduits and allows the engine to operate normally. When the operator wishes to change from the circumstance shown in FIG. 8 to the circumstance shown in FIG. 10, the operator merely disconnects the fluid couplings 50 from their respective studs 67 at the plate 62 and allows the second ends 102 of the first and second flexible conduits, 10A and 10B, to drop free and away from the plate 62. Then, the operator pushes the handle 40 downward toward the plate to move the retainer 20 from its position near the plate 62 to a position near the bottom of the engine 80. This movement of the retainer 20 forces the flexible conduits, 10A and 10B, to the position shown in FIG. 10 and places the second ends 102 of the conduits at a lower point than their first ends 104. This allows the engine 80 to drain into the bilge.

Figure 11:
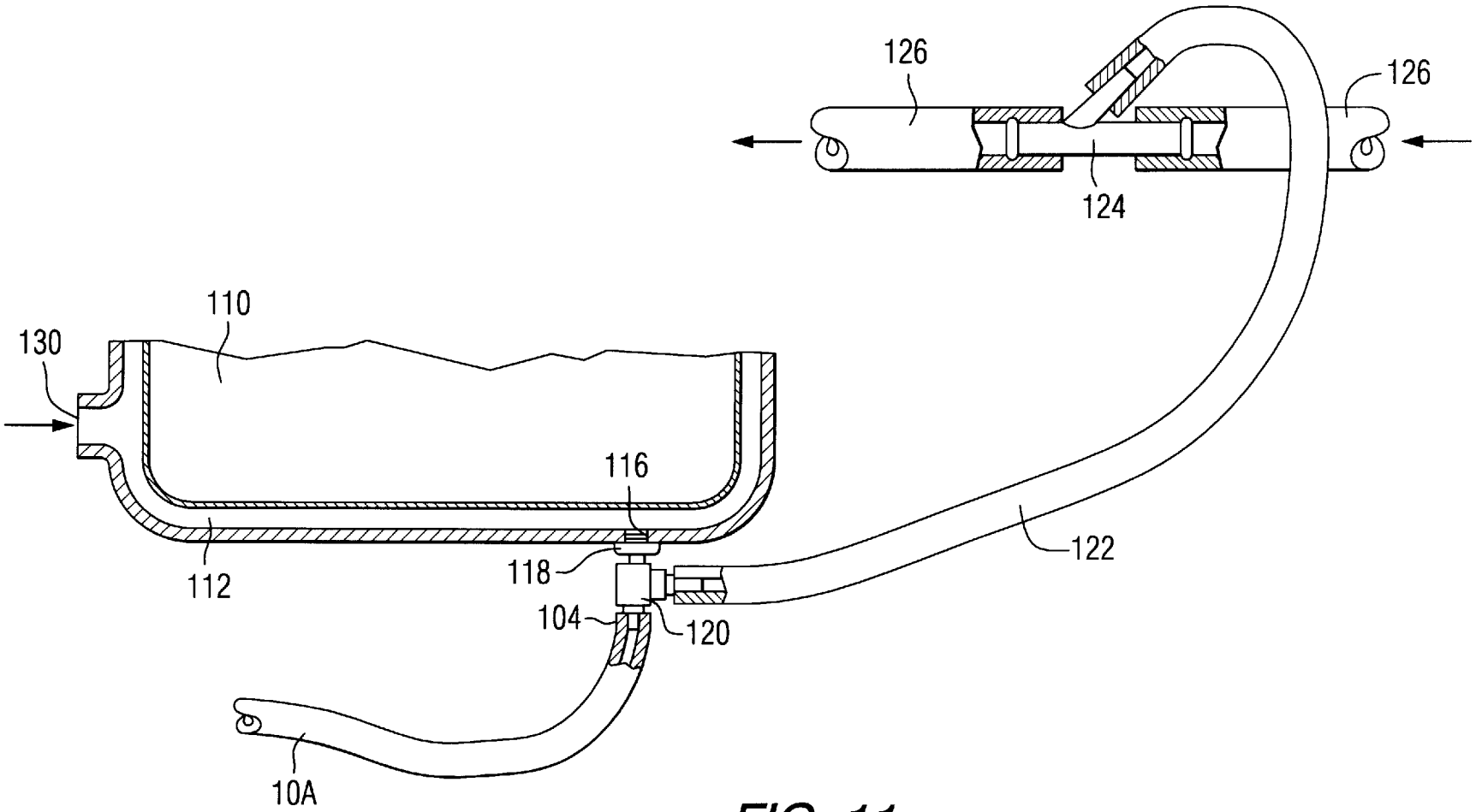
FIG. 11 shows a modification of the present invention which inhibits the collection of residue in the region of the first end of a flexible conduit.

FIG. 11 shows a beneficial arrangement that can be used in conjunction with the present invention. An exhaust manifold 110 is shown having a water jacket 112 for purposes of cooling the exhaust manifold. The first end 104 of the flexible conduit 10A is connected to a first opening 116 by a threaded connector 118. Instead of the direct connection of the first end 104 to the first opening 16, a T-connector 120 is provided, as shown in FIG. 11, to allow an additional conduit 122, or hose, to be connected between the T-connector 120 and a Y-connector 124. The Y-connector 124 is connected in series with a water conduit 126 that conducts inlet water from the transom of a boat toward the thermostat housing of the engine in the direction of the arrows shown in FIG. 11. This conduit 126 is typically a one inch inside diameter hose.

When connected as shown in FIG. 11, a quantity of water will continually flow from the Y-connector 124 through hose 122 toward the T-connector 120 because of the pressure differentials normally existing between the hose 126 and the water jacket 112 of the exhaust manifold. In a typical arrangement, water flows from the engine into an inlet 130 of the water jacket 112 to cause water to flow around the exhaust manifold. After passing through the water jacket 112, the cooling water is ejected back to the body of water in which the boat is operating. When the second end of the flexible conduit 10A is attached to the stud on the plate, the second end is blocked. As a result, water passing from the Y-connector 124 to the T-connector 120 will not flow through the flexible conduit 10A but, instead, will flow through connector 118 into the water jacket 112. This continual flow of water upward through connector 118 into the water jacket 112 will help to prevent any potential buildup of debris or residue at the first opening 116. If residue or debris were allowed to collect at the first opening 116, proper draining of the exhaust manifold water jacket 112 could be adversely affected. If the first opening 116 is blocked by debris or residue, the present invention may not work properly to drain the water manifold 112 through the flexible conduit 10A. By continually directing a flow of water through hose 122, this potential problem is avoided.

With reference to FIG. 10, it can be seen that another beneficial option is available to the boat operator through the use of the present invention. Either one of the two flexible conduits, 10A and 10B, can be attached to a source of fresh water under pressure to cause the fresh water to flow from the second end 102 of the selected flexible conduit toward the first end 104 and through the cooling system of the engine. It is preferred to use flexible conduit 10A for these purposes because it allows the engine to be flushed more efficiently and completely. This can be facilitated by a garden hose connector which is available from the Seatech Corporation and can be quickly connected into the fluid coupling 50 at the end of one of the conduits, 10A or 10B, and threaded onto the end of a garden hose. This adaptation is not specifically shown in the Figures, but can be easily understood by any boat owner. This allows the operator to flush the cooling system, with the water first passing through the engine cooling system, then overboard through the engine exhaust manifold and elbow and finally through the stern drive unit. This process is particularly useful after the engine is used in a salt water or contaminated water application. In either procedure, the engine can be easily flushed with fresh water by using the present invention. This flushing procedure is to be performed with the engine in an off condition. There is no need to operate the engine. Typically, a ten minute flushing operation is sufficient to adequately flush the engine. This can be performed with the boat in or out of the water.

Although the present invention has been described with particular specificity and illustrated to show a most preferred embodiment, it should be understood that other embodiments of the present invention are also within its scope. Minor changes in specific details of the invention do not remove it from the scope of the description above.

I claim:

1. An engine cooling system, comprising:

a first opening extending through a first portion of said engine and into said cooling system;

a first flexible conduit having a first end connected in fluid communication with said first opening;

a retainer movably attached to said first flexible conduit and movable between said first end of said first flexible conduit and a second end of said first flexible conduit;

a handle;

a tether attached between said handle and said retainer; and whereby said second end of said first flexible conduit is movable, in response to manual movement of said handle, from a first position above said first opening to a second position below said first opening.

2. The engine cooling system of claim 1, further comprising:

a stationary bracket, said tether passing through an aperture in said bracket, said aperture being disposed between said handle and said retainer.

3. The engine cooling system of claim 2, wherein:

said stationary bracket comprises a plate through which said aperture is formed, said plate having a stud attached thereto, said stud being shaped to be received in liquid sealing association within said second end of said first flexible conduit.

4. The engine cooling system of claim 3, further comprising:

a fluid coupling attached to said second end of said first flexible conduit, said fluid coupling being shaped to receive said stud therein.

5. The engine cooling system of claim 4, wherein:

said stationary bracket is rigidly attached to said engine.

6. The engine cooling system of claim 1, further comprising:

a second opening extending through a second portion of said engine and into said cooling system;

a second flexible conduit having a first end connected in fluid communication with said second opening, said retainer being movably attached to said second flexible conduit and movable between said first end of said second flexible conduit and a second end of said second flexible conduit; and whereby said second end of said first flexible conduit and said second end of said second flexible conduit are both movable, in response to manual movement of said handle, from a first position above said first and second openings to a second position below said first and second openings.

7. The engine cooling system of claim 6, wherein:

said first opening is formed in an exhaust manifold of said engine and said second opening is formed in a block of said engine.

8. The engine cooling system of claim 1, wherein:

said tether is a flexible rod.

9. The engine cooling system of claim 8, wherein:

said flexible rod comprises a steel wire reinforced structure with a nonmetallic coating.

10. The engine cooling system of claim 1, further comprising:

a liquid connection between a source of cooling water and said first flexible conduit, said source of cooling water being at a first pressure magnitude when said engine is operating, said first opening being at a second pressure magnitude when said engine is operating, said first pressure magnitude being greater than said second pressure magnitude; and whereby said cooling water is caused to flow from said source of cooling water, through said liquid connection, and through said first opening when said engine is operating and said second end of said first flexible conduit is closed.

11. An engine cooling system, comprising:

a first opening extending through a first portion of said engine and into said cooling system;

a first flexible conduit having a first end connected in fluid communication with said first opening;

a retainer movably attached to said first flexible conduit and movable between said first end of said first flexible conduit and a second end of said first flexible conduit;

a handle;

a tether attached between said handle and said retainer;

a second opening extending through a second portion of said engine and into said cooling system;

a second flexible conduit having a first end connected in fluid communication with said second opening, said retainer being movably attached to said second flexible conduit and movable between said first end of said second flexible conduit and a second end of said second flexible conduit;

a stationary bracket, said tether passing through an aperture in said bracket, said aperture being disposed between said handle and said retainer; and whereby said second end of said first flexible conduit and said second end of said second flexible conduit are both movable, in response to manual movement of said handle, from a first position above said first and second openings to a second position below said first and second openings.

12. The engine cooling system of claim 11, wherein:

said stationary bracket comprises a plate through which said aperture is formed, said plate having a stud attached thereto, said stud being shaped to be received in liquid sealing association within said second end of said first flexible conduit.

13. The engine cooling system of claim 12, further comprising:

a fluid coupling attached to said second end of said first flexible conduit, said fluid coupling being shaped to receive said stud therein.

14. The engine cooling system of claim 13, wherein:

said stationary bracket is rigidly attached to said engine.

15. The engine cooling system of claim 11, wherein:

said first opening is formed in an exhaust manifold of said engine and said second opening is formed in a block of said engine.

16. The engine cooling system of claim 11, wherein:

said tether is a flexible rod which comprises a steel wire reinforced structure with a nonmetallic coating.

17. An engine cooling system, comprising:

a first opening extending through a first portion of said engine and into said cooling system;

a first flexible conduit having a first end connected in fluid communication with said first opening;

a retainer movably attached to said first flexible conduit and movable between said first end of said first flexible conduit and a second end of said first flexible conduit;

a handle;

a tether attached between said handle and said retainer;

a second opening extending through a second portion of said engine and into said cooling system;

a second flexible conduit having a first end connected in fluid communication with said second opening, said retainer being movably attached to said second flexible conduit and movable between said first end of said second flexible conduit and a second end of said second flexible conduit;

a stationary bracket, said tether passing through an aperture in said bracket, said aperture being disposed between said handle and said retainer;

a fluid coupling attached to said second end of said first flexible conduit, said fluid coupling being shaped to receive said stud therein; and whereby said second end of said first flexible conduit and said second end of said second flexible conduit are both movable, in response to manual movement of said handle, from a first position above said first and second openings to a second position below said first and second openings.

18. The engine cooling system of claim 17, wherein:

said stationary bracket comprises a plate through which said aperture is formed, said plate having a stud attached thereto, said stud being shaped to be received in liquid sealing association within said second end of said first flexible conduit.

19. The engine cooling system of claim 18, wherein:

said stationary bracket is rigidly attached to said engine.

20. The engine cooling system of claim 19, wherein:

said first opening is formed in an exhaust manifold of said engine and said second opening is formed in a block of said engine, and said tether is a flexible rod comprising a steel wire reinforced structure with a nonmetallic coating.

* * * * *